US006843198B1

(12) United States Patent
Witbeck

(10) Patent No.: US 6,843,198 B1
(45) Date of Patent: Jan. 18, 2005

(54) TRANSPORT, LAUNCH AND RECOVERY CRAFT

(75) Inventor: Norman C. Witbeck, Washington, DC (US)

(73) Assignee: Columbia Research Corporation, Washington, DC (US)

( * ) Notice: Subject to any disclaimer, the term of this patent is extended or adjusted under 35 U.S.C. 154(b) by 0 days.

(21) Appl. No.: 10/602,512

(22) Filed: Jun. 24, 2003

Related U.S. Application Data

(60) Provisional application No. 60/399,406, filed on Jul. 31, 2002.

(51) Int. Cl.[7] ..... B63B 35/44
(52) U.S. Cl. ..... 114/258; 114/259
(58) Field of Search ..... 114/258, 253, 114/259, 260, 356, 357, 322, 254; 440/38

(56) References Cited

U.S. PATENT DOCUMENTS

| | | | | | |
|---|---|---|---|---|---|
| 1,113,450 | A | | 10/1914 | Laurenti | |
| 2,398,274 | A | | 4/1946 | Albert | |
| 3,403,652 | A | | 10/1968 | Hardy | |
| 3,508,510 | A | | 4/1970 | Frankel | |
| 3,734,046 | A | * | 5/1973 | Schmidt et al. | 114/259 |
| 5,050,523 | A | | 9/1991 | Schwemin et al. | |
| 5,222,454 | A | | 6/1993 | Meyer | |
| 5,265,549 | A | * | 11/1993 | Cernier | 114/61.1 |
| 5,855,180 | A | | 1/1999 | Masters | |
| 6,302,049 | B1 | | 10/2001 | Weiler | |
| 6,367,406 | B1 | * | 4/2002 | Sahr et al. | 114/357 |

* cited by examiner

*Primary Examiner*—Stephen Avila
(74) *Attorney, Agent, or Firm*—Krieg DeVault Lundy LLP

(57) ABSTRACT

A transport, launch and recovery marine craft is provided that is capable of transporting, deploying and retrieving cargo at sea, either while idle or while underway. A hinged well deck selectively lowers the cargo into the water, and lifts the cargo out of the water during retrieval. Means for raising and lowering the well deck include hydraulic or pneumatic cylinders connected between the well deck and an overhead support. A winch may be used for loading and unloading the cargo.

35 Claims, 3 Drawing Sheets

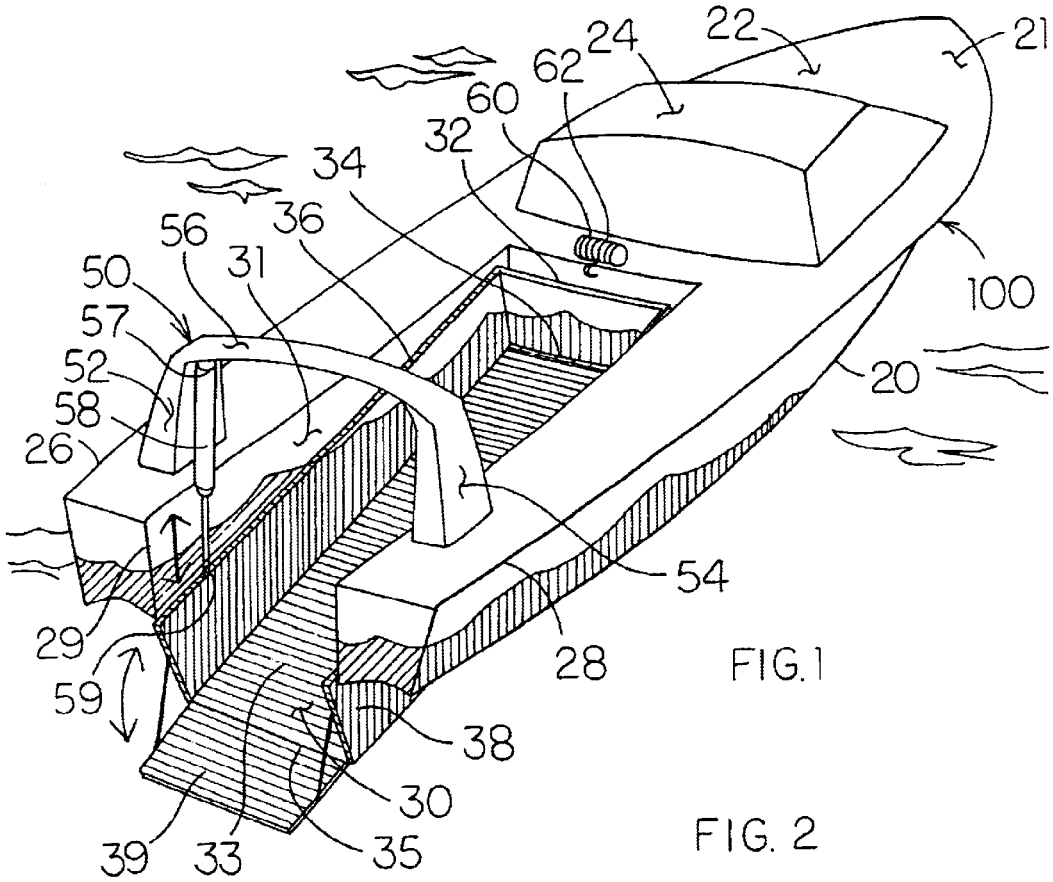
FIG. 1
FIG. 2
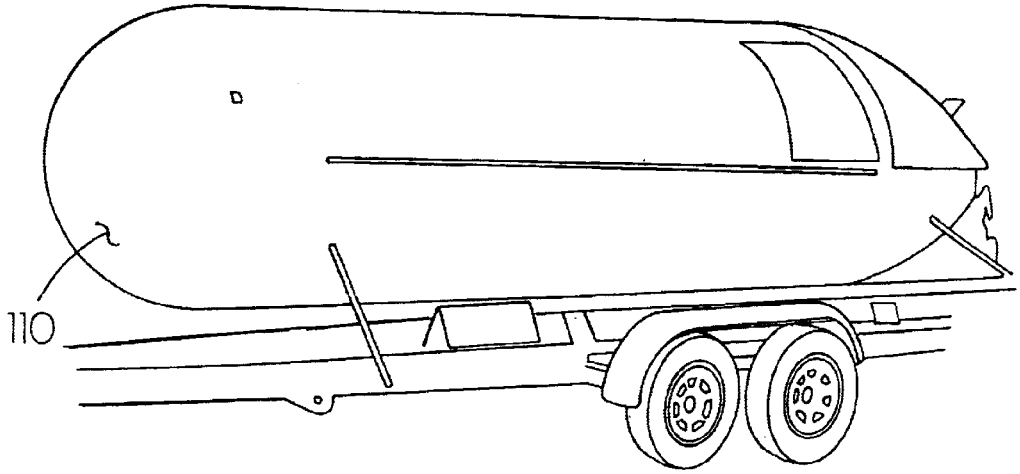

TRANSPORT, LAUNCH AND RECOVERY CRAFT

This application claims priority based on U.S. Provisional Patent Application Ser. No. 60/399,406, entitled "Launch and Recovery Craft Apparatus," and filed Jul. 31, 2002.

BRIEF DESCRIPTION OF THE DRAWINGS

FIG. 1 is a perspective view of one embodiment of a transport, launch and recovery marine craft, shown with a hinged well deck and the stern gate in a lowered position;

FIG. 2 is a perspective view of a trailer mounted Dolphin Class SDV;

Figure 3:
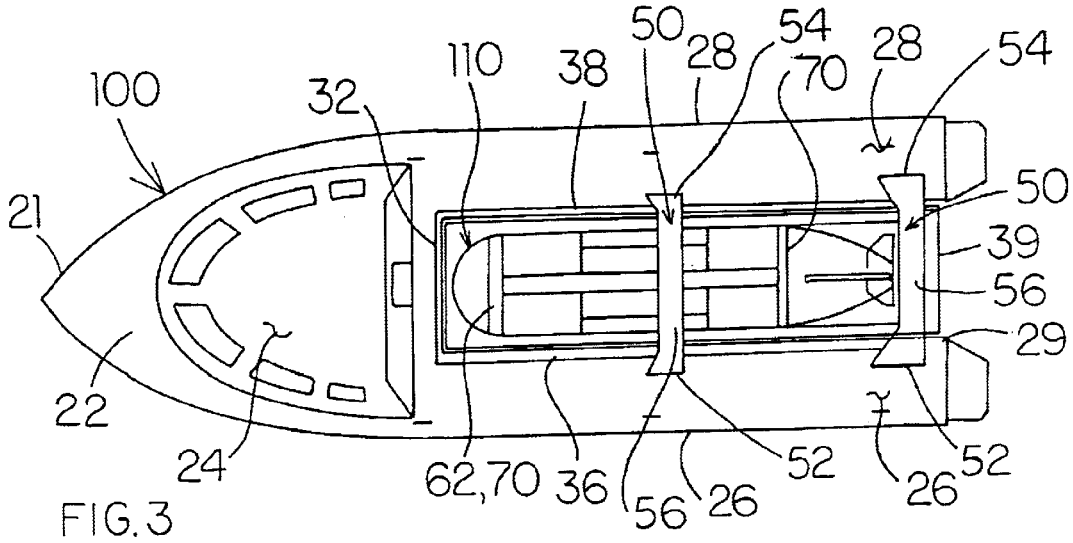
FIG. 3 is a top view of one embodiment of the craft, showing a SDV loaded within the hinged well deck, with both the well deck and the stern gate raised.

These drawings are provided for illustrative purposes only and should not be used to unduly limit the scope of the present invention.

DETAILED DESCRIPTION OF EMBODIMENTS OF THE INVENTION

The marine craft 100 of the present invention is designed to transport, deploy and retrieve cargo 110. In one embodiment, the cargo 110 comprises a marine vessel distinct from the craft 100. In other embodiments, such marine vessel is submersible and can navigate similar to a small submarine. In yet other embodiments, the marine vessel cargo 110 comprises a Dolphin Class swimmer delivery vehicle (SDV).

The craft 100 in one embodiment provides the capability for rapid transport of SDVs 110 in both training and operational scenarios. In other embodiments, the craft can deploy a SDV having a crew of up to eight personnel and their equipment. In yet other embodiments, the craft 100 has a fully loaded cruise speed of up to 26 knots, carries 1,000 gallons of diesel fuel and has a cruising range of 500 nautical miles. In yet other embodiments, the craft 100 provides fast, long-range, inconspicuous transportation of SDVs.

The craft 100 comprises several standard components for a seaworthy vessel, including a hull 20, a bow 21 and a stern 25, and selectively including a fore deck 22 and a cabin 24. The embodiments of the craft 100 further comprise components for transporting, deploying and retrieving cargo 110, for example, a SDV. In one embodiment, the craft 100 comprises an open hull portion 31 at the stern 25. In other embodiments, the open hull portion 31 is defined by a pair of spaced apart buoyant structures 26, 28 that extend rearwardly from the bow 21 of the craft 100 at laterally opposite sides thereof. The stern 25 has an open end 29 for ingress and egress of cargo floating in the water to and from the open hull portion 31. A well deck 30 is secured within the open hull portion 31. In yet other embodiments, the well deck 30 is configured to receive and support various cargo 110 therein, for example, a SDV. The hull 20 is suitably configured for travel though water. In one embodiment, the hull 20 is configured for rapid travel through water.

The well deck 30 is hinged at a connected end 34 to a transverse portion of the hull generally adjacent the open hull portion 31. The well deck 30 in one embodiment includes upstanding wall 32 and sidewalls 36, 38, which may be connected at their respective intersections. The upstanding wall 32 extends from the connected end 34, and the upstanding sidewalls 36, 38 extend from laterally opposite sides of the well deck that connect the connected end 34 and the stern end 35. The well deck 30 is configured to fit within the open hull portion 31.

In one embodiment, the well deck 30 has a hinged stern gate 39 which selectively raises and lowers by any known means. The stern gate 39 is located at a stern end 35 of the well deck 30 and is generally positioned at the open end 29 of the open hull portion 31. The stern gate 39 raises and lowers about its hinged securement in order to open and close access to the well deck 30 and to aid in retaining cargo 110, for example, a SDV, within the well deck 30. In yet other embodiments, the well deck 30 further comprises an upwardly facing bottom surface 33 for supporting cargo 10 received within the well deck 30.

In one embodiment, the well deck 30 further comprises a cradle (not shown) with damped, flexible mounts (not shown) secured to the bottom surface 33 for mitigating shock loads imparted on the cargo 110 during high-speed transit.

Figure 4:
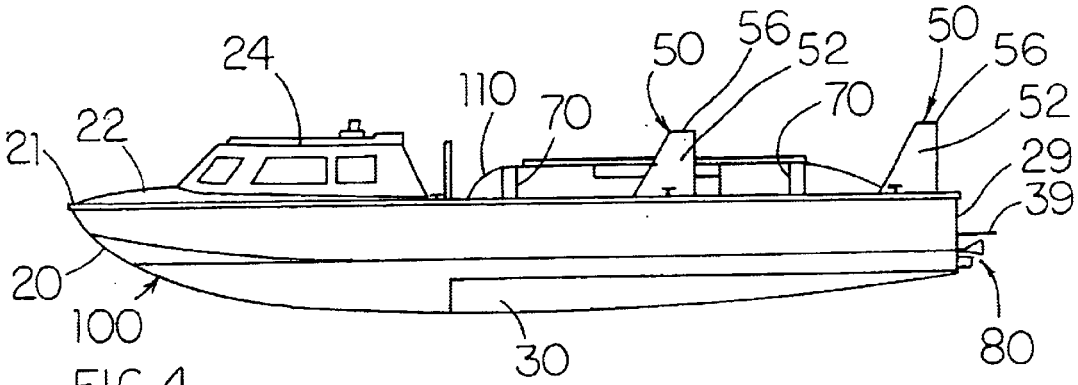
FIG. 4 is a side view of one embodiment of the craft, with the hinged well deck in a raised position and the stern gate lowered.
Figure 5:
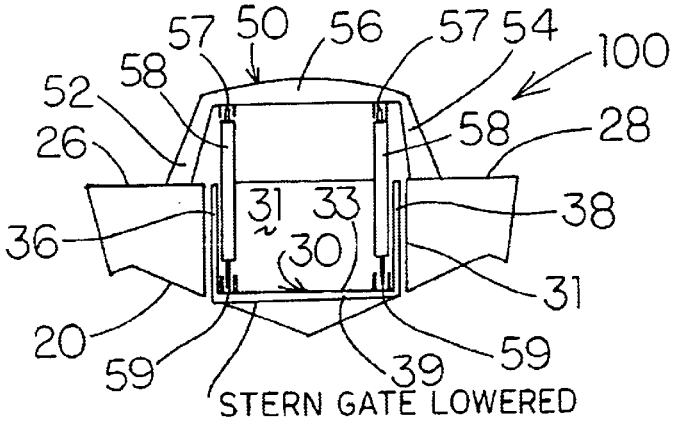
FIG. 5 is a rear view of one embodiment of the craft, showing the well deck in a raised position and the stern gate lowered.

Means is generally provided on the craft 100 for selectively raising and lowering the stern end of the well deck 30 relative to the connected end 34. In one embodiment, when the well deck 30 is in a raised position, as shown in FIGS. 3, 4 and 5, the exterior bottom of the well deck 30 is substantially aligned with the exterior surface of the hull 20 such that the hull generally appears as a contiguous piece from bow 21 to stern 25. In other embodiments, the exterior bottom of the well deck 30 in a raised position matches the exterior bottoms of the buoyant structures 26, 28 to provide the appearance and functionality of a single shell hull.

In one embodiment, the raising and lowering means comprises hydraulic or pneumatic cylinders 58 extending between a raised, overhead support 50 and the well deck 30. The overhead support 50 extends between the buoyant structures 26, 28 in proximity to the stern 25 of the craft 100. The overhead support 50 includes a first upright portion 52, a second upright portion 54, and a structural bridge 56 extending therebetween. More than one raised overhead support 50 may be used, as shown in FIGS. 3, 4 and 6.

The cylinders 58 are connected in one embodiment at an upper end 57 thereof to the structural bridge 56 and at a lower end 59 thereof to the upper edge of the upstanding sidewalls 36, 38 of the bottom well deck 30, as shown in FIG. 1. In other embodiments, the lower end 59 of each cylinder 58 may be connected directly to the bottom surface 33 of the well deck 30 as shown in FIG. 5 and FIG. 6.

Figure 6:
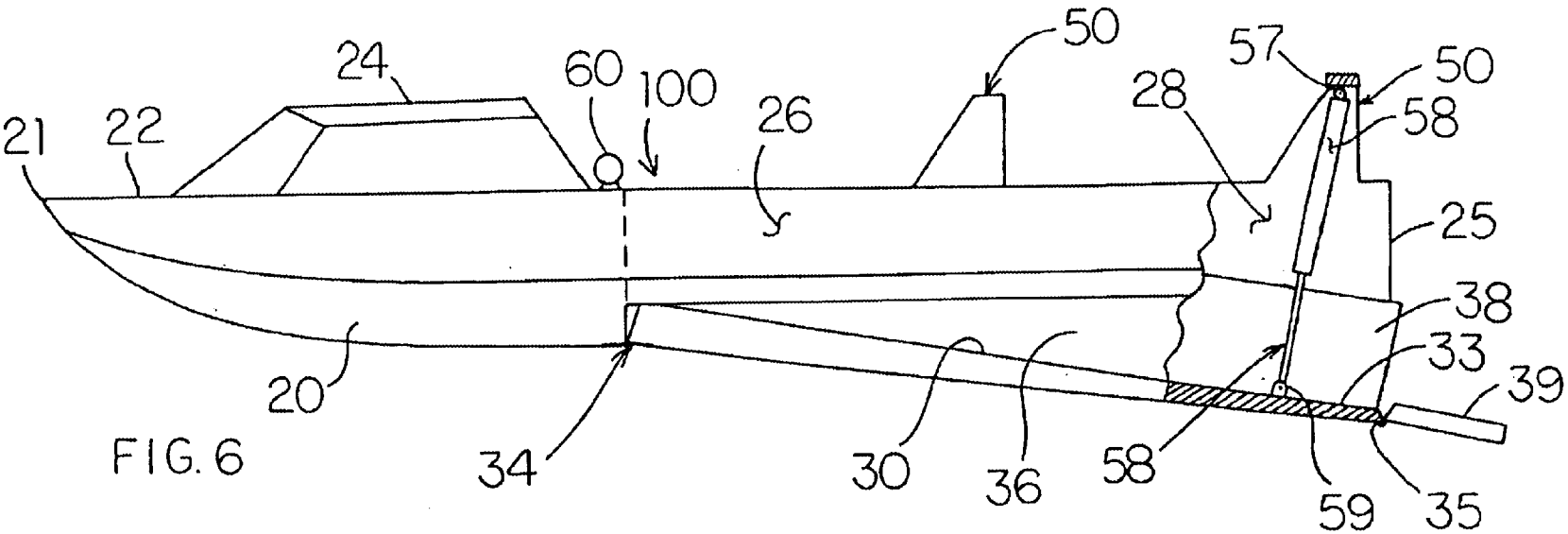
FIG. 6 is a side view with a partial sectional view of one embodiment of the craft, with both the well deck and the tern gate in a lowered position.

In one embodiment, the cylinders 58 lower the well deck 30 about the connected end 34 into a lowered position as shown in FIG. 1 and FIG. 6 for ease of selectively deploying and retrieving cargo 10, for example, a SDV.

In one embodiment, a suitable winch 60 located in a forward portion of the craft 100 adjacent the open hull portion 31 is used to retract a cable 62 connected between the craft 100 and the cargo 110, to pull the cargo into the well deck 30. In other embodiments, the winch 60 and cable 62 further aid in securing the cargo 110 within the well deck 30.

When floating cargo 110, such as a SDV, is retrieved from the water and secured within the well deck 30, the cargo is positioned for transport by raising the well deck 30 about the connected end 34 with cylinders 58, as shown in FIG. 3 and FIG. 4. In one embodiment, the winch 60 is alternatively used to extend the cable 62 to deploy the cargo 110 from the craft 100, when the well deck 30 is lowered into a lowered position as shown in FIG. 1 and FIG. 6.

Cargo 110 may be loaded within the well deck 30 upon damped, flexible mounts (not shown) provided in the well deck 30. In one embodiment, the cargo 110, once loaded, is secured in place with a suitable releasable fastening means 70, such as straps, clamps, line, cord, cable, etc.

In one embodiment, a suitable cover (not shown) is used to cover the cargo when the craft 100 is underway. The cover may be a soft top, canvas, or tarp, which completely covers the open hull portion 31 and the cargo.

In one embodiment, the craft 100 is manufactured at least in part of fiberglass and/or aluminum or other materials suitable for a marine craft and for light weight, corrosion resistance and structural strength.

In one embodiment, the craft 100 is powered by at least one engine (not shown) coupled to one or more jet drives 80. In other embodiments, the engines are six cylinder in-line diesel engines rated at about 420 bhp each. In yet other embodiments, the craft 100 has a fuel capacity of about 1,000 gallons. In yet other embodiments, the engines will provide a fully loaded cruising range of 500 nautical miles.

In one embodiment, the craft 100 is fitted with a plurality of hard points (not shown) that enable the craft 100 to be lifted by a larger ship's crane (not shown), and deployed into the water with cargo pre-loaded in the well deck 30.

The scope of the prevent invention is not strictly limited to the specific embodiments disclosed herein. The invention may be practiced by one skilled in this art by utilizing numerous features and adaptations practiced in the art. Such features and adaptations are intended to be included within the scope of this disclosure, and the accompanying claims.

What is claimed is:

1. A marine craft, comprising: an open hull portion at the stern of said craft, a well deck hingedly connected at one end thereof to the hull adjacent said open hull portion, and means for selectively raising and lowering a stern end of said well deck about said one end, said one end being generally opposite said stern end, said open hull portion defined by a pair of spaced apart buoyant structures extending rearwardly from opposite lateral sides of the bow of said craft, said well deck further comprising an exterior bottom that is substantially aligned with the exterior surface of the hull when said well deck is in a raised position and a stern gate hingedly secured to said stern end, said well deck configured to receive and support cargo therein.

2. The marine craft of claim 1 wherein said well deck further comprises a substantially upwardly facing bottom surface, said one end and said stern end being connected via laterally opposite sides, and upstanding walls extending from said one end and each of said laterally opposite sides.

3. The marine craft of claim 1 wherein said means for selectively raising and lowering said stern end comprises at least one hydraulic or pneumatic cylinder extending between an overhead support and said well deck, said overhead support extending between said pair of buoyant structures.

4. The marine craft of claim 3 wherein said overhead support further comprises first and second upright portions and a structural bridge extending between said upright portions, said first upright portion extending substantially upwardly from one of said pair of buoyant structures, said second upright portion extending substantially upwardly from the other of said pair of buoyant structures, said means further comprising at least two of said cylinders, each said cylinder having an upper end and a lower end, said upper end of one of said cylinders being connected to said structural bridge substantially adjacent said first upright portion, said upper end of another of said cylinders being connected to said structural bridge substantially adjacent said second upright portion.

5. The marine craft of claim 4 wherein said lower ends are respectively connected to said well deck at laterally opposite sides thereof that connect said one end and said stern end.

6. The marine craft of claim 4 wherein said lower ends are respectively connected to said well deck at upper edges of upstanding walls extending from laterally opposite sides of said well deck.

7. The marine craft of claim 1 wherein said well deck further comprises a cradle having damped flexible mounts, said cradle configured to mitigate shock loads exerted upon cargo received within said well deck during high-speed or turbulent transit of said craft.

8. The marine craft of claim 1 wherein said stern gate is configured to be selectively raised and lowered about said stern end for selectively opening and closing access of cargo into and out of said well deck.

9. The marine craft of claim 1 further comprising a winch apparatus mounted to a forward portion of said craft adjacent said open hull portion, said winch apparatus comprising a retractable cable having connection means at a distal end thereof for selectively retrieving and deploying cargo to and from said well deck and for securing said cargo within said well deck during transit of said craft.

10. The marine craft of claim 1 wherein said well deck further comprises a releasable fastening means for securing cargo received within said well deck.

11. The marine craft of claim 1 further comprising a cover releasably secured to said craft and extending over said open hull portion, said cover selected from the group of covers consisting of soft tops, canvas, and tarps.

12. The marine craft of claim 1 further comprising a cabin and a fore deck configured about the bow of said craft, said cabin being forward of said open hull portion.

13. The marine craft of claim 1 wherein said craft is manufactured substantially from at least one of the materials selected from the group of materials consisting of fiberglass and aluminum.

14. The marine craft of claim 1 further comprising at least one engine secured within the hull of said craft, each said engine coupled to at least one jet drive.

15. The marine craft of claim 14 wherein each said engine comprises a 6-cylinder in-line diesel engine rated at about 420 bhp.

16. The marine craft of claim 15 further comprising a fuel capacity of about 1,000 gallons and a cruising range of about 500 nautical miles.

17. The marine craft of claim 14 wherein said craft is configured for high-speed transit in a body of water.

18. The marine craft of claim 17 wherein said craft has a maximum speed of about 26 knots.

19. The marine craft of claim 14 wherein at least one engine is secured within each said buoyant structure, each said buoyant structure further comprising a jet drive extending substantially rearward.

20. The marine craft of claim 1 wherein said cargo comprises a distinct marine vessel.

21. The marine craft of claim 20 wherein said marine vessel is selectively navigable as a submersible vessel.

22. The marine craft of claim 21 wherein said marine vessel comprises a Dolphin Class swimmer delivery vehicle.

23. A marine craft, comprising: an open hull portion at the stern of said craft, a well deck hingedly connected at one end thereof to the hull adjacent said open hull portion, and means for selectively raising and lowering a stern end of said well deck about said one end, said one end being generally opposite said stern end, said open hull portion defined by a pair of spaced apart buoyant structures extending rearwardly from opposite lateral sides of the bow of said craft, said well deck further comprising an exterior bottom that is substantially aligned with the exterior surface of the hull when said well deck is in a raised position and a stern gate hingedly secured to said stern end, said well deck configured to receive and support cargo therein, said well deck further comprising a substantially upwardly facing bottom surface, laterally opposite sides connecting said one end and said stern end, and upstanding walls extending from said one end and each of said laterally opposite sides, said means for selectively raising and lowering said stern end comprising at least two hydraulic or pneumatic cylinders extending between an overhead support and said well deck, said overhead support extending between said pair of buoyant structures and comprising first and second upright portions and a structural bridge extending between said upright portions, said first upright portion extending substantially upwardly from one of said pair of buoyant structures, said second upright portion extending substantially upwardly from the other of said pair of buoyant structures, each said cylinder having an upper end and a lower end, said upper end of one of said cylinders being connected to said structural bridge substantially adjacent said first upright portion, said upper end of another of said cylinders being connected to said structural bridge substantially adjacent said second upright portion, said craft further comprising at least one engine secured within the hull of said craft, each said engine coupled to at least one jet drive and comprising a 6-cylinder in-line diesel engine rated at about 420 bhp having a fuel capacity of about 1,000 gallons, a cruising range of about 500 nautical miles and a maximum speed of about 26 knots, at least one said engine being secured within each said buoyant structure, each said buoyant structure further comprising a jet drive extending substantially rearward.

24. The marine craft of claim 23 wherein said cargo comprises a Dolphin Class swimmer delivery vehicle.

25. A marine craft comprising a pair of spaced apart hull portions joined together by a decking area, said craft having an open hull portion at the stern of said craft, a well deck hingedly connected to said craft at one end thereof to the hull adjacent said open hull portion, and means for selectively raising and lowering a stern end of said well deck about said one end between said hull portions, said one end being generally opposite said stern end, a stern gate hingedly secured to said stern end, said well deck configured to receive and support cargo therein, said well deck having an upwardly facing bottom surface, said one end and said stern end being connected by a laterally opposite sides, and upstanding walls extending from said one end and each of said laterally opposite sides.

26. The marine craft of claim 25 wherein said means for selectively raising and lowering said stern end comprises at least one hydraulic or pneumatic cylinder extending between an overhead support and said well deck, said overhead support extending between said pair of buoyant structures.

27. The marine craft of claim 25 wherein said overhead support further comprises first and second upright portions and a structural bridge extending between said upright portions, said first upright portion extending substantially upwardly from one of said pair of buoyant structures, said second upright portion extending substantially upwardly from the other of said pair of buoyant structures, said means further comprising at least two of said cylinders, each said cylinder having an upper end and a lower end, said upper end of one of said cylinders being connected to said structural bridge substantially adjacent said first upright portion, said upper end of another of said cylinders being connected to said structural bridge substantially adjacent said second upright portion.

28. The marine craft of claim 25 wherein said lower ends are respectively connected to said well deck at laterally opposite sides thereof that connect said one end and said stern end.

29. The marine craft of claim 25 wherein said lower ends are respectively connected to said well deck at upper edges of upstanding walls extending from laterally opposite sides of said well deck.

30. The marine craft of claim 25 wherein said well deck further comprises a cradle having damped flexible mounts, said cradle configured to mitigate shock loads exerted upon cargo received within said well deck during high-speed or turbulent transit of said craft.

31. The marine craft of claim 25 wherein said stern gate is configured to be selectively raised and lowered about said stern end for selectively opening and closing access of cargo into and out of said well deck.

32. The marine craft of claim 25 further comprising a winch apparatus mounted to a forward portion of said craft adjacent said open hull portion, said winch apparatus comprising a retractable cable having connection means at a distal end thereof for selectively retrieving and deploying cargo to and from said well deck and for securing said cargo within said well deck during transit of said craft.

33. The marine craft of claim 25 wherein said well deck further comprises a releasable fastening means for securing cargo received within said well deck.

34. The marine craft of claim 25 further comprising a cover releasably secured to said craft and extending over said open hull portion, said cover selected from the group of covers consisting of soft tops, canvas, and tarps.

35. The marine craft of claim 25 further comprising a cabin and a fore deck configured about bow of said craft, said cabin being forward of said open hull portion.

* * * * *